US009545533B2

(12) United States Patent
Boyer

(10) Patent No.: US 9,545,533 B2
(45) Date of Patent: Jan. 17, 2017

(54) SLACKLINE BALANCE BOARD

(71) Applicant: Rejean Boyer, Laval (CA)

(72) Inventor: Rejean Boyer, Laval (CA)

( * ) Notice: Subject to any disclaimer, the term of this patent is extended or adjusted under 35 U.S.C. 154(b) by 10 days.

(21) Appl. No.: 14/864,549

(22) Filed: Sep. 24, 2015

(65) Prior Publication Data

US 2016/0089577 A1 Mar. 31, 2016

Related U.S. Application Data

(60) Provisional application No. 62/055,274, filed on Sep. 25, 2014.

(51) Int. Cl.

| | |
|---|---|
| ***A63B 22/16*** | (2006.01) |
| ***A63B 7/08*** | (2006.01) |
| ***A63B 22/18*** | (2006.01) |
| ***A63B 26/00*** | (2006.01) |
| ***A63C 17/01*** | (2006.01) |
| ***A63B 69/00*** | (2006.01) |

(52) U.S. Cl.

CPC ..... *A63B 7/085* (2013.01); *A63B 22/16* (2013.01); *A63B 22/18* (2013.01); *A63B 26/003* (2013.01); *A63B 69/0093* (2013.01); *A63C 17/015* (2013.01)

(58) Field of Classification Search

CPC ..... A63B 22/18; A63B 22/16; A63B 26/003; A63C 17/01; A63C 17/015

See application file for complete search history.

(56) References Cited

U.S. PATENT DOCUMENTS

| | | | | |
|---|---|---|---|---|
| 3,630,540 | A | 12/1971 | Smith | |
| 3,895,794 | A | 7/1975 | England | |
| 4,505,477 | A | 3/1985 | Wilkinson | |
| 4,705,272 | A | 11/1987 | Rupprecht | |
| 4,826,159 | A | 5/1989 | Hersey | |
| 4,911,440 | A | 3/1990 | Hyman et al. | |
| 5,152,691 | A | 10/1992 | Moscarello | |
| 5,643,164 | A | 7/1997 | Teff | |
| 5,795,277 | A | 8/1998 | Bruntmyer | |
| 6,017,297 | A | 1/2000 | Collins | |
| 6,196,558 | B1 | 3/2001 | Simon | |
| 6,267,394 | B1 | 7/2001 | Bouden | |
| 6,352,268 | B1 | 3/2002 | Peart | |
| 6,616,583 | B1 | 9/2003 | Stack | |
| 6,896,274 | B2 * | 5/2005 | Leslie | A63C 17/01 280/809 |
| 6,916,276 | B1 | 7/2005 | Robinson | |
| 7,479,097 | B2 | 1/2009 | Rosborough et al. | |

(Continued)

FOREIGN PATENT DOCUMENTS

DE 202011108718 U1 3/2012

OTHER PUBLICATIONS

Machine translation in English of DE 20 2011 108 718 U1.

*Primary Examiner* — Erez Gurari

(74) *Attorney, Agent, or Firm* — IPAXIO S.E.N.C.

(57) ABSTRACT

The slackline balance board is for use during slacklining It includes an elongated deck having an upper surface and a bottom surface. The deck includes opposite first and second end sections, and a medial cambered section interposed between the first and second end sections. The medial cambered section is arched upwards with reference to a longitudinal axis. Two spaced-apart slackline guides are secured to the bottom surface of the deck.

20 Claims, 15 Drawing Sheets

(56) References Cited

U.S. PATENT DOCUMENTS

| | | | |
|---|---|---|---|
| 7,566,291 | B2 | 7/2009 | Lickle |
| 7,748,722 | B2 | 7/2010 | Kane |
| 7,798,514 | B2 | 9/2010 | Canaday et al. |
| 8,360,943 | B2 | 1/2013 | Smith |
| 8,371,604 | B1 | 2/2013 | Soucy |
| 8,465,032 | B2 | 6/2013 | Hill et al. |
| 8,556,289 | B2 | 10/2013 | Luthardt |
| 8,734,308 | B1 | 5/2014 | Joslin |

* cited by examiner

SLACKLINE BALANCE BOARD

CROSS-REFERENCE TO RELATED APPLICATION

The present case claims the benefit of U.S. Patent Application No. 62/055,274 filed on 25 Sep. 2014,which application is hereby incorporated by reference in its entirety.

TECHNICAL FIELD

The technical field relates generally to slacklining, more particularly to balance boards adapted for use during slacklining

TECHNICAL BACKGROUND

Slacklining is a sport or physical activity that takes place on a narrow strip of flat webbing extending between two anchor points, such as large trees, rocks or any other suitable anchor points. The webbing is stretched to support the weight of a user standing thereon, although the webbing is not necessarily stretched so as to be rigidly taut like a tightrope.

The webbing on which slacklining is practiced is referred to as a "slackline". It can be made of synthetic fibers, such as nylon or others, woven to form a strong fabric. A slackline is generally about 1 to 2 inches (2.5 to 5 cm) in width. A slackline is thus considerably larger than a tightrope and this allows the weight of a user to be distributed over a much larger area. A slackline is often positioned horizontally and relatively close to the ground surface, for instance at a height of about 12 to 24 inches (30 to 60 cm). The section extending between the two opposite anchor points is often about 10 to 12 feet (305 to 365 cm) in length. Variants exist. For instance, some users can practice slacklining higher from the ground surface and/or using longer slacklines. Some slacklines may not be set horizontally.

When slacklining, users may be simply standing on the slackline. Others may combine various movements such as walking, standing on only one foot, pivoting, etc. Acrobatic moves or stunts can be done by experienced users. Users may adjust the tension in the slackline to vary the amplitude of the sagging, the bouncing effect and other characteristics. The tension can be adjusted using a ratchet mechanism or the like. Variants are possible as well.

A slackline may be installed outdoors or indoors. Although slacklining is mostly practiced above a ground surface on which the user can stand, a slackline can also extend over a water surface.

Slacklining is currently a sport where users interact with the slackline either with shoes or barefooted. This limits the number of possible actions that can be accomplished on a slackline. More specifically, no additional piece of equipment specifically designed for use between the slackline and the user's feet during slacklining is available.

Some sports or physical activities are part of a category that can be referred to as boardsports. Boardsports involve specialized boards as primary pieces of equipment and their users stand in an upright position above these boards. Surfing, skateboarding, windsurfing and snowboarding, to name just a few, are examples of boardsports. Other examples exist as well. The feet of the users may or may not be strapped onto the board, depending on the kind of boardsport and/or the kind of boards chosen by a particular user.

Balance boards also involve a board as a primary piece of equipment. Balance boards are designed for use on cylindrical or spherical objects. Thus, unlike in boardsports such as surfing, skateboarding, windsurfing and snowboarding, the user does not travel over a given distance but remains essentially at the same location throughout the entire duration of the physical activity. The user's body must stay balanced enough to keep the board's tips from touching the ground surface and to prevent the user from falling off the board. Balance boards are often used for leisure, balance training, athletic training, brain development and physical therapy, to name just a few.

Using a balance board on a slackline has not been suggested yet, even if such equipment would represent a breakthrough in slacklining Also, using a balance board on a slackline has its own challenges since the board must have certain characteristics and features to interact with a slackline, as well the ground surface, in a proper way. For instance, a slackline balance board would need to be relatively stable when the user is on the slackline, easy to use and to position with reference to the slackline, and have a relatively simple and inexpensive construction. It must also be able to engage the ground surface and withstand impacts, if applicable. These desirable characteristics have not been found hitherto. Moreover, one cannot simply use an existing board, for instance one designed for other boardsports, and use it on a slackline as a balance board. The same is also true for existing balance boards. Since they are designed for use on cylindrical or spherical objects, they cannot address the challenges specific to slacklining

SUMMARY

The goal of the proposed concept is to provide a slackline balance board that is specifically designed to transform slacklining into a boardsport.

Accordingly, the present concept relates to the introduction of balance boards adapted for use on a slackline and capable of overcoming the challenges of the unique environment which slacklining offers. The slackline balance board allows a user to stand on the slackline by placing the slackline balance board directly thereon, for instance perpendicular or parallel to the slackline to name just a few possible positions. This board has many advantages. With a balance board placed between the user's feet and the slackline, different new balancing and even acrobatic moves may be performed. This can greatly diversify how one uses a slackline and offer numerous new possibilities.

In one aspect, there is provided a slackline balance board for use on a slackline, the slackline balance board including: an elongated deck having an upper surface and a bottom surface, the deck including opposite first and second end sections; and a medial cambered section interposed between the first and second end sections, the medial cambered section being arched upwards with reference to a longitudinal axis; and two spaced-apart slackline guides secured to the bottom surface of the deck.

In another aspect, there is provided a slackline balance board as shown, described and/or suggested herein.

In another aspect, there is provided a method of using a slackline balance board as shown, described and/or suggested herein.

More details on the various aspects and features of the proposed concept will become apparent in light of the detailed description which follows and the appended figures where some examples of the slackline balance board are shown.

DETAILED DESCRIPTION

Figure 1:
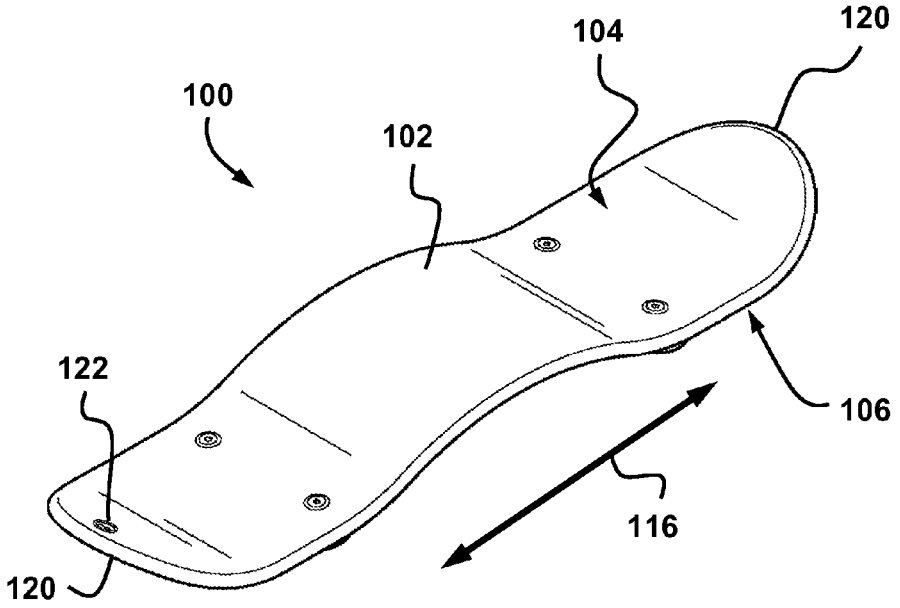
FIG. 1 is a top perspective view of an example of a slackline balance board in accordance with the proposed concept.

FIG. 1 is a top perspective view of an example of a slackline balance board 100 in accordance with the proposed concept. This board 100 includes characteristics and features that are specifically designed for slacklining, more particularly for interacting with a slackline.

The illustrated slackline balance board 100 is approximately the same size as a standard skateboard. Like a standard skateboard, it includes an elongated deck 102, namely a deck whose length along a longitudinal axis exceeds its width. The bottom surface 106 is designed to engage a slackline. The deck 102 also has an upper surface 104 and a bottom surface 106. However, unlike in a standard skateboard, the deck 102 has a unique shape and is not generally flat, among other things. The longitudinal axis is schematically represented in FIG. 1 at 116.

The deck 102 can be made of a dense but slightly resilient monolithic material. The deck 102 must resist the weight of the user on the slackline but still be light enough to provide the user with a maximum freedom of movement. It can be manufactured using a similar process as for the manufacturing of skateboards, for instance using multiple thin layers of wood that are glued together and shaped by compression using a mold. The various layers can be configured and disposed so as to vary the level of flexibility of the deck 102 in one or more axes. In some implementations, the deck 102 can include one or more materials to replace or in addition to wood, for instance materials such as plastics, polyvinyl carbonate, carbon fiber, etc. Other variants are also possible.

Figure 2:
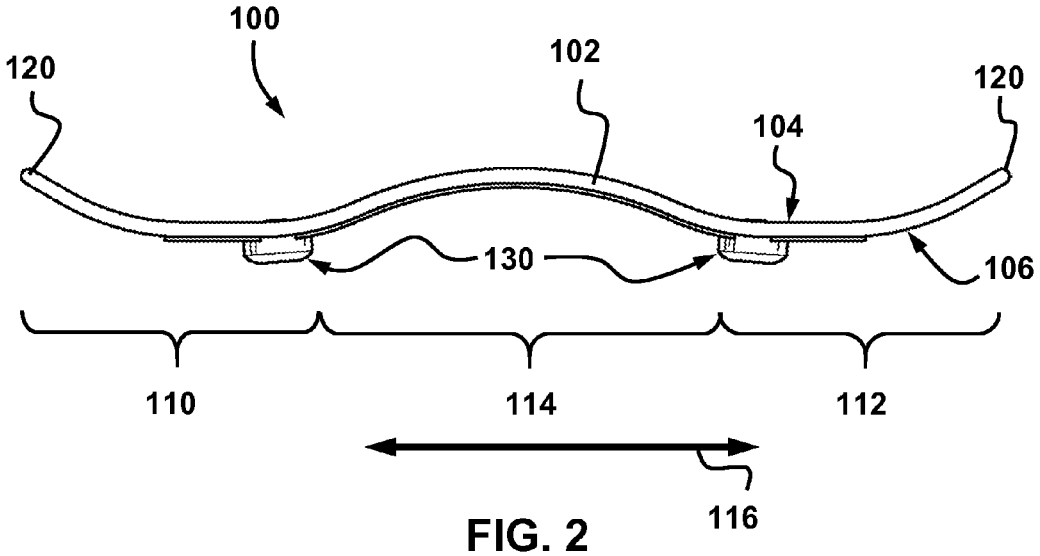
FIG. 2 is a side view of the slackline balance board shown in FIG. 1.

FIG. 2 is a side view of the slackline balance board 100 shown in FIG. 1. As can be seen in FIG. 2, the deck 102 generally defines opposite first and second end sections 110, 112, between which is interposed a medial cambered section 114. All three sections 110, 112, 114 are made integral with one another to form the deck 102. In FIG. 2, the medial cambered section 114 is arched upwards with reference to the longitudinal axis 116. The deck 102 also has a relatively constant thickness in all three sections 110, 112, 114 and its peripheral side edges are free of flanges or other parts that could interfere with a slackline engaging the bottom surface 106 when the slackline balance board 100 is placed thereon. Variants are possible as well.

In the illustrated example, the medial cambered section 114 amounts to about half of the total length of the deck 102. The first and second end sections 110, 112 are also equal in length. Variants are possible as well.

The slackline balance board 100 further includes two spaced-apart slackline guides 130 secured to the bottom surface 106 of the deck 102. The slackline guides 130 extend transversally and are adjacent to a junction of the medial cambered section 114 with reference to a corresponding one among the first and second end sections 110, 112. The slackline guides 130 are positioned under the end sections 110, 112 and their inner transversal edges define the boundaries between the corresponding end sections 110, 112 and the medial cambered section 114. The slackline guides 130 are useful to act as stoppers, thereby limiting movements of the slackline balance board 100 on the slackline and helping the user in keeping the slackline within the same section 110, 112, 114 underneath the board 100.

In the illustrated example, each slackline guide 130 includes two spaced-apart and downwardly-projecting guide members 132. They can be fixed onto the slackline balance board 100 using, for instance, corresponding screws or using bolts attached the threaded inserts passing through the thickness of the slackline balance board 100. Threaded inserts for the guide member fasteners are visible in FIGS. 1 and 3. The guide members 132 have a circular cross section in this illustrated example. Variants are possible as well. For instance, one can secure the guide members 132 differently without using screws or bolts. The guide members 132 can also be molded or otherwise formed together. Still, one can design other kinds of slackline guides 130, even one that are molded underneath the deck 102. Another possibility is that the slackline guides 130 be more selective, for instance allowing the slackline to slid without much restriction from the medial cambered section 114 to the end sections 110, 112, but not the opposite.

Figure 3:
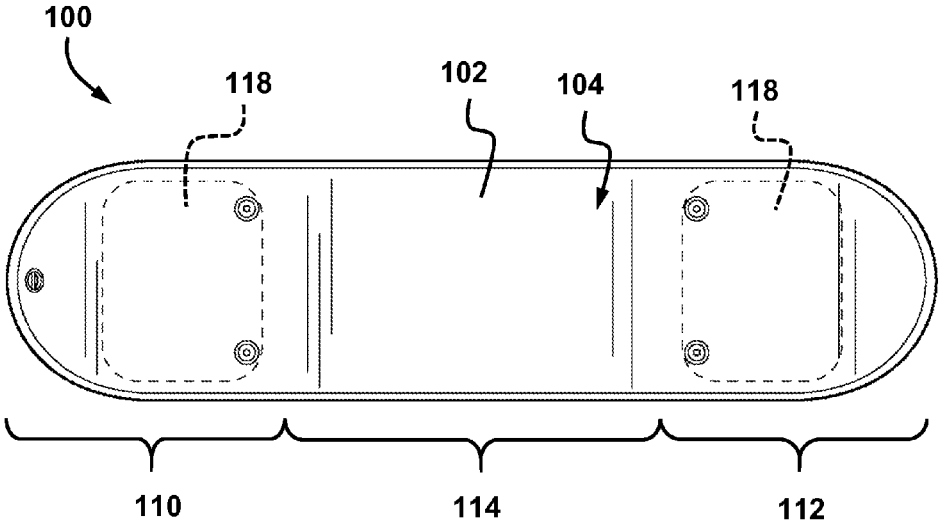
FIG. 3 is a top view of the slackline balance board shown in FIG. 1.

FIG. 3 is a top view of the slackline balance board 100 shown in FIG. 1. As can be seen, the first and second end sections 110, 112 create two substantially flat footrest zones 118 on the upper surface 104. These footrest zones 118 are where a user will place his or her feet most of the time. In most designs, the user's feet should be set at a distance that is approximately equal to the width of the user's shoulder. Nevertheless, variants are possible as well.

Each of the first and second end sections 110, 112 of the deck 102 illustrated in FIG. 1 has a tip 120 that is curved upwards. These curved tips 120 can facilitate the positioning of the feet over the slackline balance board 100 when no foot retaining system is provided. Also, when the slackline balance board 100 is in a tilted position, these curved tips 120 can help supporting the outer part of the foot. The curved tip feature may be omitted in some designs, or be provided at only at one of the board's end, depending on the implementation.

The slackline balance board 100 of FIG. 1 is substantially symmetrical (i.e. perfectly or almost perfectly) with reference to the longitudinal axis 116. The left and the right side are thus substantially mirror images. It is also substantially symmetrical with reference to a transversal centerline thereof, i.e. the line that extends perpendicular to the longitudinal axis 116 halfway between the opposite tips 120 of the slackline balance board 100. Variants are possible as well.

In use, the slackline balance board 100 can be positioned at various angles on a slackline. Most beginners may start by setting the slackline balance board 100 substantially perpendicular or transversal to a slackline The bottom surface 106 underneath the medial cambered section 114 is arched-shaped. The shaped profile creates a self-centering tendency that will help keeping the slackline at a neutral balanced position when the user tries to maintain balance thereon, thereby greatly improving the overall stability. Moreover, the bottom arched surface allows the slackline balance board 100 to engage the slackline directly from above, even if the slackline balance board 100 is oriented at an angle with reference to the horizontal. The slackline will tend to be positioned at the highest point of the arched surface underneath the slackline balance board 100 and this will help the user staying over the slackline instead of slipping away. More experienced users may use slackline balance boards 100 with less curvature.

A non-slip material can be applied or otherwise provided on at least some of the upper surface 104 of the slackline balance board 100. This will improve grip and, for instance, help the user to stay on the slackline balance board 100 while doing tricks or the like. The non-slip material may be for example a grip tape, Ethylene vinyl acetate (EVA) foam or any other suitable product that can enhance adherence. A grip tape can be generally defined as a sheet of paper or fabric with adhesive on one side and a surface similar to sandpaper on the other. Variants are possible as well.

The slackline balance board 100 illustrated in FIG. 1 includes a hole 122 at the tip 120 of the first end section 110. This hole 122 can be used as an attachment point for a leash. The other end of the leash can be attached to one of the user's ankles, legs or shoes. A leash can be useful in some circumstances, for instance to prevent the slackline balance board 100 from being catapulted uncontrollably during an acrobatic maneuver or to drift away too far when the slackline is used over a water surface. Some slackline balance boards may have two of such hole 122, one at each end, or may have one at the center, but others may omit this feature as well.

Figure 4:
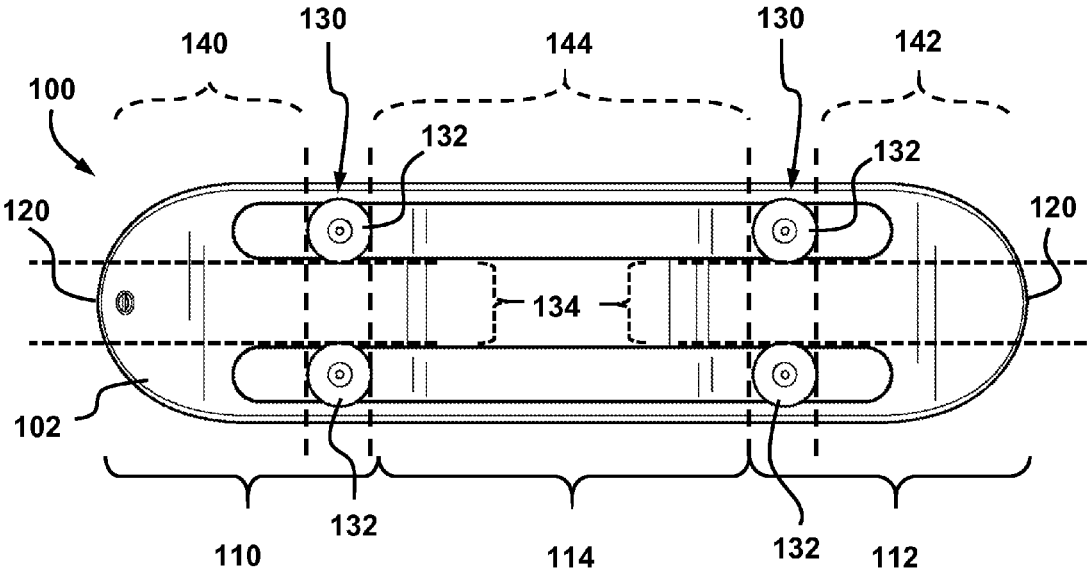
FIG. 4 is a bottom view of the slackline balance board shown in FIG. 1.

FIG. 4 is a bottom view of the slackline balance board 100 shown in FIG. 1. As can be seen in FIG. 4, the guide members 132 of the illustrated example define a longitudinal slackline-receiving channel 134 between their inner sides. The longitudinal slackline-receiving channel 134 has a width that is at least equal to the width of the slackline. The longitudinal slackline-receiving channels 134 of the two slackline guides 130 are in registry with one another. This way, the slackline balance board 100 can be easily centered when disposed parallel to the slackline. The longitudinal slackline-receiving channel 134 will guide the slackline.

In addition to the longitudinal slackline-receiving channel 134, three guiding areas 140, 142, 144 are also created under the bottom surface 106 by the slackline guides 130. The first and second ones are outer guiding areas 140, 142. They are located between the outer side of a corresponding one of the slackline guides 130 and the nearest tip 120. The inner guiding area 144 is located between the inner sides of the two slackline guides 130. These guiding areas 140, 142, 144 are useful when the slackline balance board 100 is placed perpendicular on the slackline or at an angle. The guide members 132 act as stoppers to prevent the slackline balance board 100 from easily sliding off the slackline.

It should be noted that in FIG. 4, the straight stippled lines under the deck 102 represent the approximate boundaries of the longitudinal slackline-receiving channel 134 and the approximate boundaries of the guiding areas 140, 142, 144. As can be seen, in the illustrated example, the stippled lines delimiting the longitudinal slackline-receiving channel 134 are perpendicular to the stippled lines delimiting the guiding areas 140, 142, 144 since the guide members 132 are in rectangular alignment with one another. Variants are possible as well.

When the slackline balance board 100 is placed perpendicular to the slackline and the slackline engages the bottom surface 106 within the inner guiding area 144, the two opposite pairs of guide members 132 will help to keep the slackline inside the inner guiding area 144, particularly when the board 100 is oriented to define an angle with reference to the horizontal. The curved arched surface underneath the slackline balance board 100 is what essentially maintains the slackline centered when the board 100 is horizontal or almost horizontal.

When the slackline balance board 100 is placed perpendicular to the slackline and the slackline engages the bottom surface 106 in one of the two outer guiding areas 140, 142, the nearest pair of guide members 132 will help to prevent the slackline from easily going into the inner guiding area 144. Finally, when the slackline balance board 100 is placed parallel to the slackline, the longitudinal slackline-receiving channel 134 will help to keep the slackline balance board 100 in alignment with the slackline.

The slackline guides 130 can be made of different materials. Examples of materials include thermoplastic, polyurethane, thermoplastic rubber, wood, etc. Other materials can be used as well.

The material can be chosen to absorb shocks and impacts, for instance when the guide members 132 hit the ground surface. The material can also be chosen to increase or decrease the friction coefficient with the slackline.

Alternatively, as aforesaid, the slackline guides 130 can also be made integral with the deck 102, for instance if the deck 102 is manufactured using a composite construction process or using a plastic injection process. The slackline guides 130 are thus secured to the bottom surface 106 of the deck 102 when the two are made integral with one another.

Figure 5:
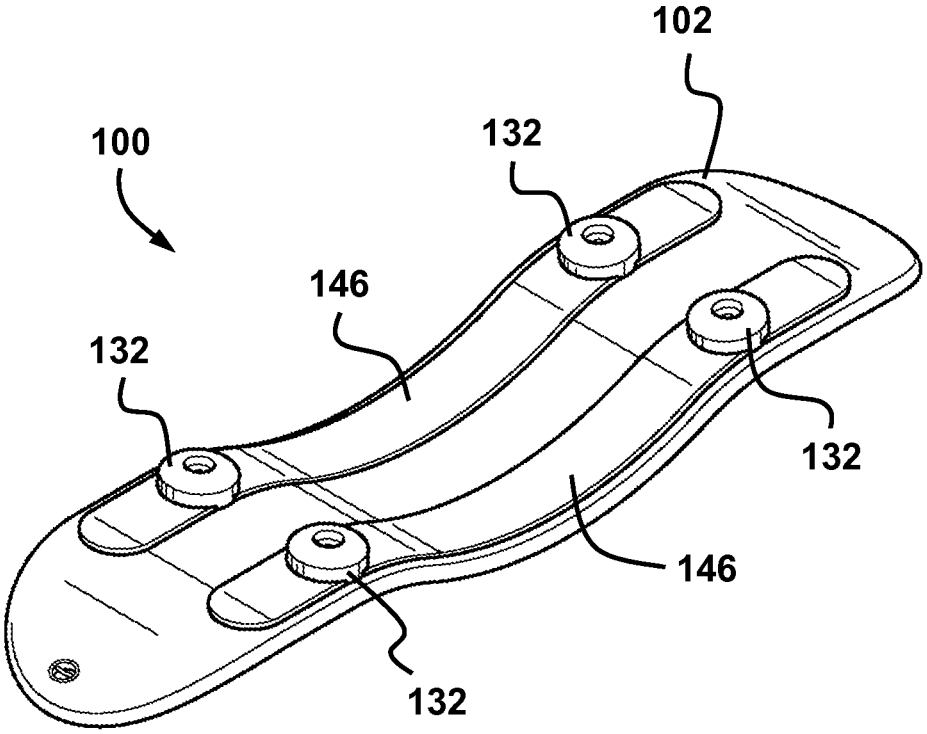
FIG. 5 is a bottom perspective view of the slackline balance board shown in FIG. 1.

FIG. 5 is a bottom perspective view of the slackline balance board 100 shown in FIG. 1. As can be seen, the bottom surface 106 of the illustrated board 100 includes areas where there are different friction levels so as to create more or less grip with the slackline. This can help, for instance, to prevent the slackline balance board 100 from sliding too freely thereon, depending on whether the user wants the slackline balance board 100 to slide easily on the slackline or not. In the illustrated example, most of the outer guiding areas 140, 142 will have more friction (i.e. more grip) compared to the inner guiding area 144. The variations of the coefficient of friction may be done using a flexible and/or textured layer, such as EVA foam, rubber or grip tape, affixed underneath the bottom surface 106. Variants are possible as well. Furthermore, the slackline itself may have a rubberized coating to increase the friction between the slackline and the bottom surface 106 of the slackline balance board 100.

In FIG. 5, the board 100 includes two spaced-apart and parallel friction-enhancing strips 146, for instance ones made of EVA foam. Other materials are also possible. These strips 146 extend parallel to the longitudinal axis 116 and are affixed to the bottom surface 106 of the slackline balance board 100 along the entire length of the medial cambered section 114 and along a portion of each end section 110, 112. Their width is approximatively that of the guide members 132 and the space between their inner parallel edges is configured to be an extension of the longitudinal slackline-receiving channels 134. This configuration increases the friction when the slackline balance board 100 is perpendicular to the slackline, but not when the slackline balance board 100 is parallel thereto. Variants are possible as well.

Figure 6:
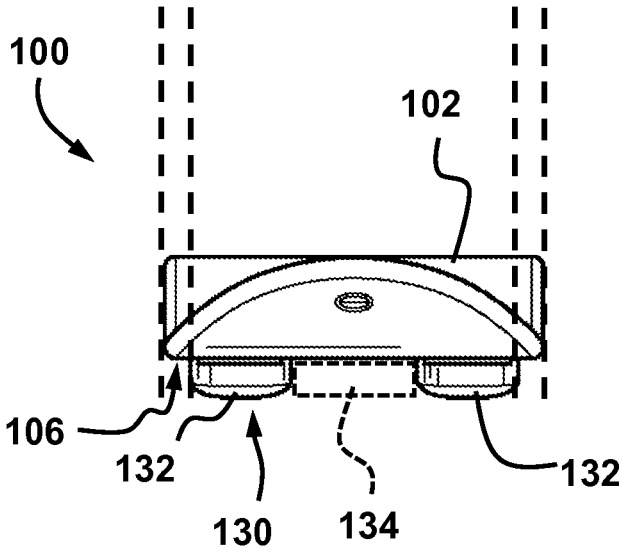
FIG. 6 is an end view of the slackline balance board shown in FIG. 1.

FIG. 6 is an end view of the slackline balance board 100 shown in FIG. 1. The longitudinal slackline-receiving channel 134 is illustrated by stippled lines between the guide members 132. When the slackline balance board 100 is horizontal and parallel to the slackline, the portion of the bottom surface 106 that is located in-between one of the pairs of guide members 132 will engage the slackline, and another portion of the bottom surface 106 that is located in-between the other one of the pairs of guide members 132 will also engage the slackline.

Also, as best shown in FIG. 6 but also in other figures, one can see that each slackline guide 130 has opposite lateral ends that are surrounded by a portion of the bottom surface 106. The lateral outer side of each guide member 132 is located inwards with reference to the side edge of the deck 102. This provides surface portions between the side edge of the deck 102 and the lateral ends of the slackline guides 130. The vertical stippled lines in FIG. 6 illustrate the width of these bottom surface portions. Variants are possible as well.

It should be noted that the longitudinal slackline-receiving channels 134, although very useful, could be omitted in some implementations.

Figure 7:
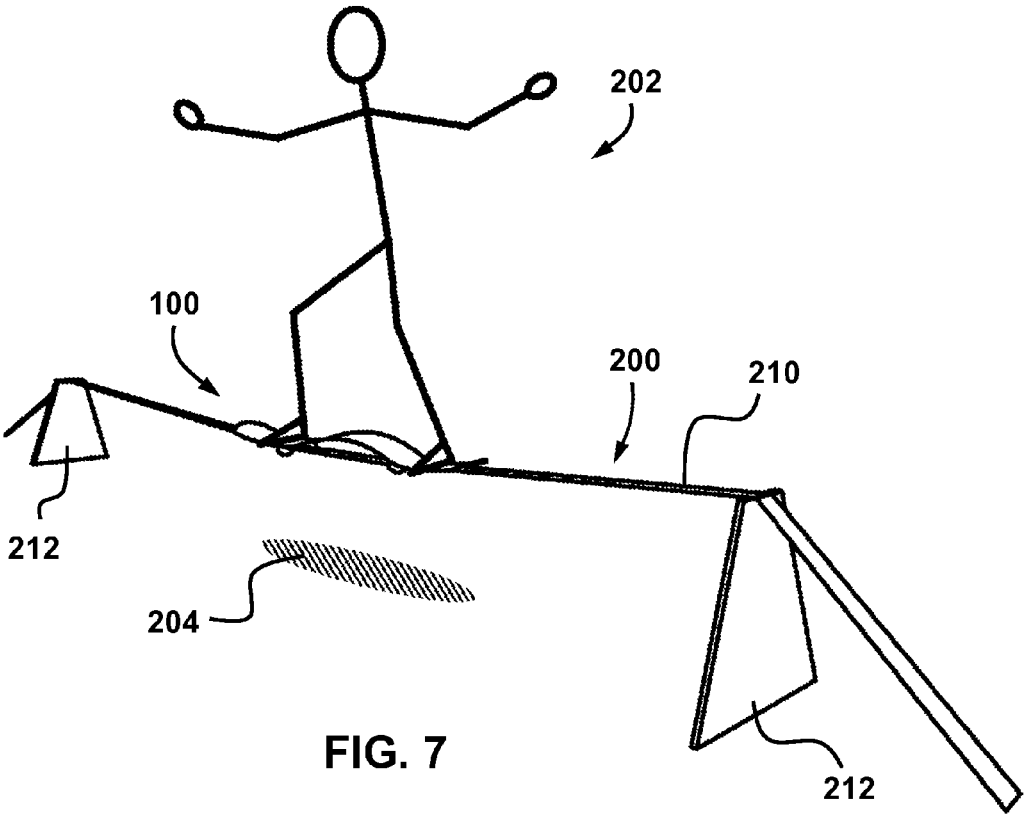
FIG. 7 is a schematic perspective view illustrating an example of a generic slackline arrangement with a user standing on the slackline balance board of FIG. 1 when the board is over the slackline.

FIG. 7 is a schematic perspective view illustrating an example of a generic slackline arrangement 200. It also shows a user 202 standing on the slackline balance board 100 of FIG. 1. The illustrated slackline arrangement 200 includes a slackline 210 extending between two anchoring points 212 above a ground surface 204. The slackline 210 can be at a height of about 12 to 24 inches (30 to 60 cm) from the ground surface 204. This generic slackline arrangement 200 is only illustrated for the sake of explanation. Many other arrangements are possible as well. FIG. 7 shows the slackline balance board 100 and the user 202 when the board 100 is over the slackline 210. The longitudinal axis 116 of the slackline balance board 100 is then parallel to the slackline 210.

Figure 8:
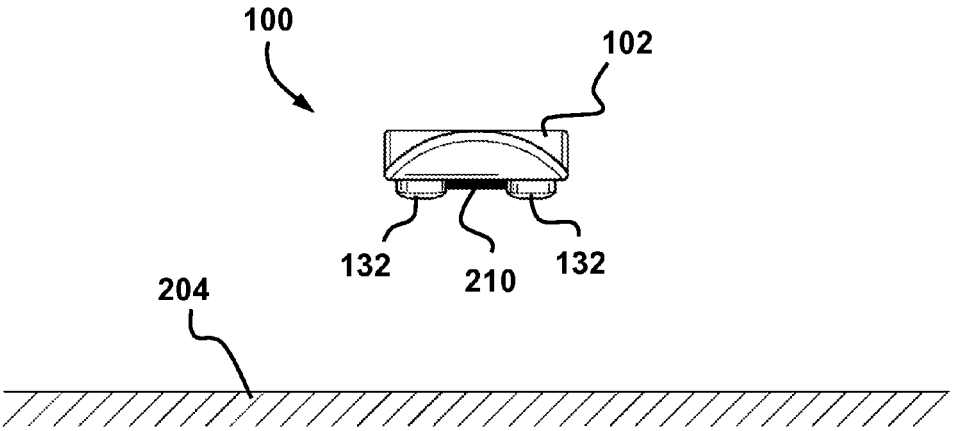
FIG. 8 is an enlarged end view illustrating the slackline balance board and the slackline in FIG. 7 without the user.

FIG. 8 is an enlarged end view illustrating the slackline balance board 100 and the slackline 210 in FIG. 7. The user 202 was omitted for the sake of simplicity. FIG. 8 shows the slackline 210 being positioned between the two guide members 132. A view from the opposite end would be substantially similar.

Figure 9:
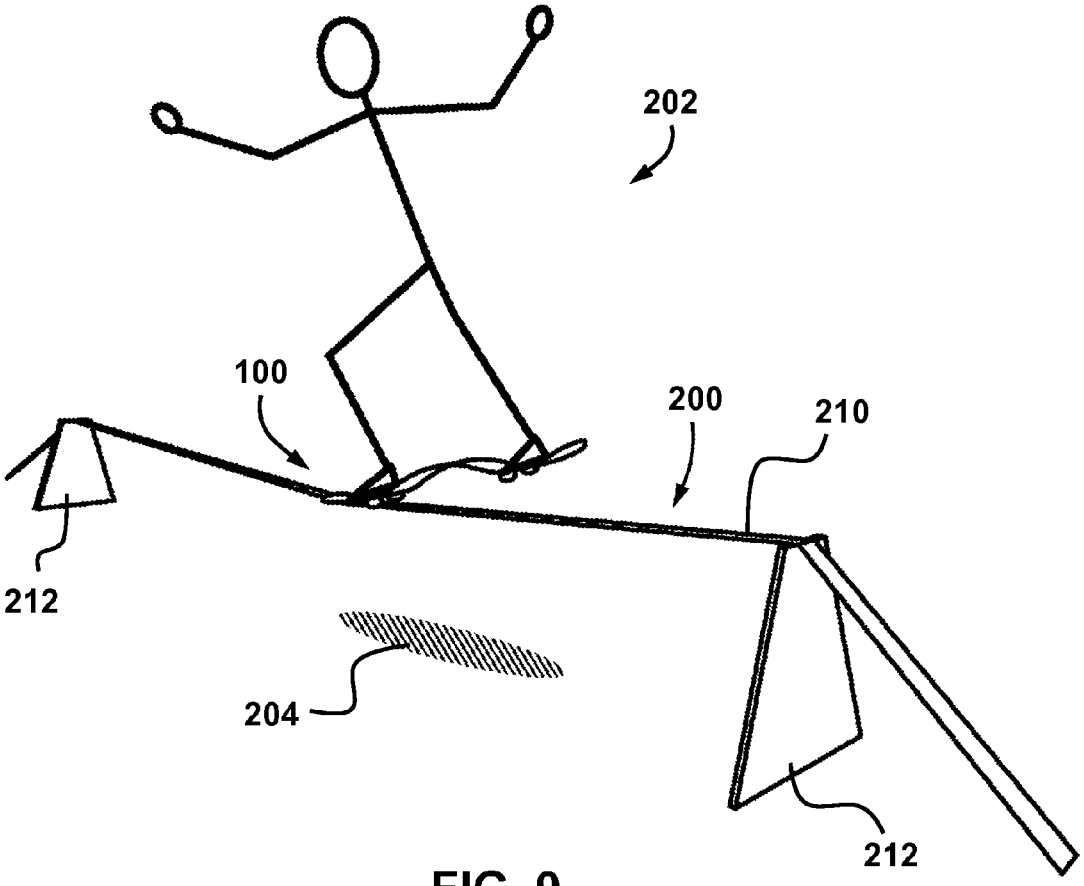
FIG. 9 is a view similar to FIG. 7, illustrating the user in another position.

FIG. 9 is a view similar to FIG. 7, illustrating the user 202 in another position. The user 202 shifted his or her weight on one side and only one among the two end sections 110, 112 engages the slackline 210. The user 202 may hold this position by finding the proper balance. Most of the surfaces underneath the user's feet engage the board 100 at the corresponding end sections 110, 112.

Figure 10:
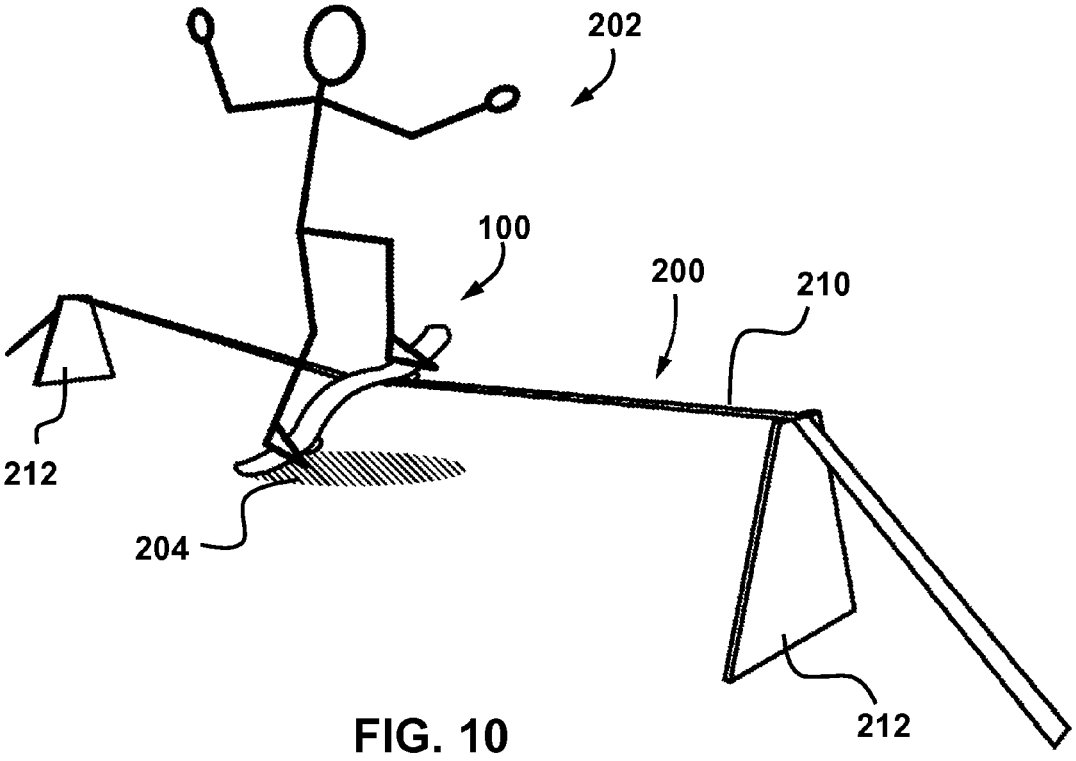
FIG. 10 is a view similar to FIG. 7, illustrating the user in a position where the slackline balance board engages both the ground surface and the slackline.

FIG. 10 is a view similar to FIG. 7, illustrating the user 202 in a position where the slackline balance board 100 engages both the ground surface 204 and the slackline 210. This position can represent what happens when the user 202 is about to go over the slackline 210, or one when the user 202 comes down from the slackline 210. The bottom surface 106 at one end of the deck 102 engages the ground surface 204 but depending on the angle of the board 100, the height of the slackline 210 and/or the construction of the board 100, the guide members 132 on the lower side can engage the ground surface 204.

Figure 11:
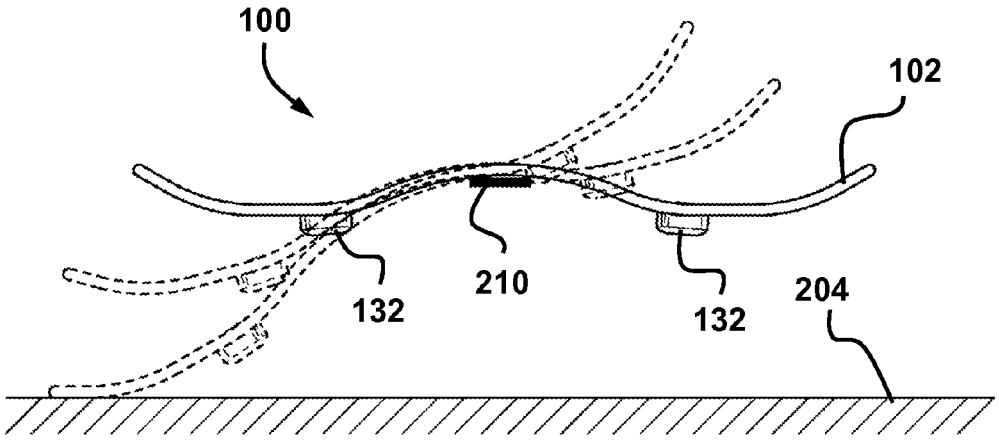
FIG. 11 is a view similar to FIG. 8, illustrating examples of positions of the slackline balance board over the slackline as the user moves from the position of FIG. 10 to a position where the weight of the user will be entirely supported by the slackline.

FIG. 11 is a view similar to FIG. 8, illustrating examples of positions of the slackline balance board 100 over the platform 210 as the user 202 moves from the position of FIG. 10 to a position where the weight of the user 202 will be entirely supported by the slackline 210.

Figure 12:
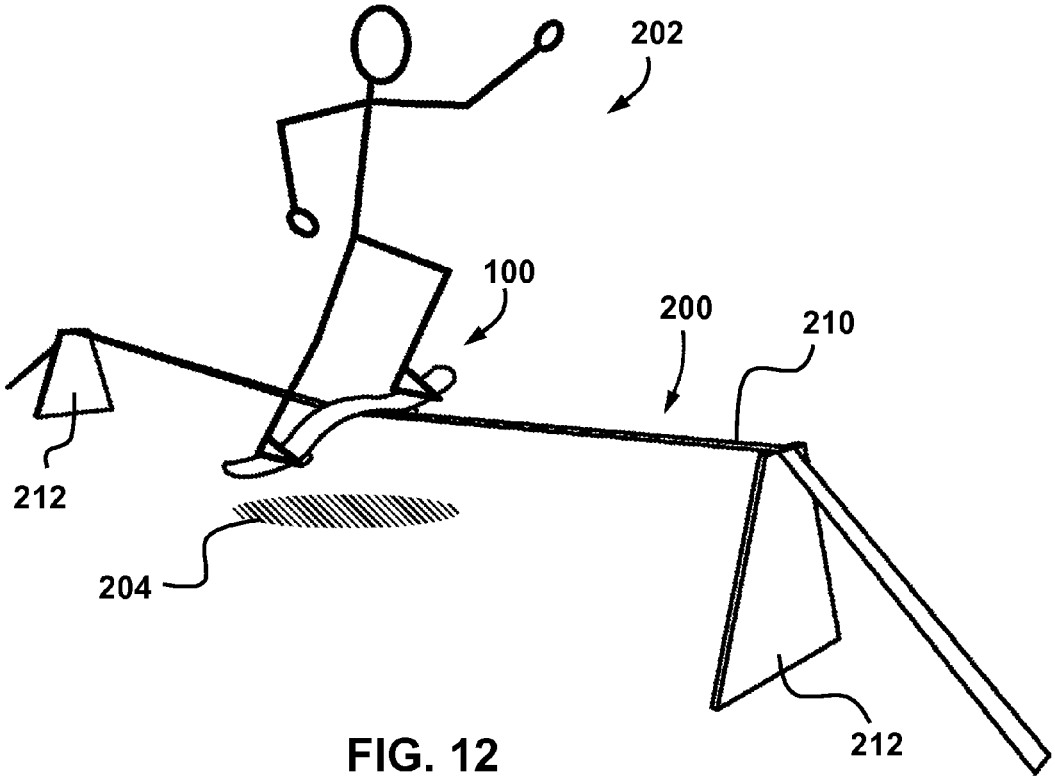
FIG. 12 is a view similar to FIG. 7, illustrating the user moving onto the slackline.

FIG. 12 is a view similar to FIG. 7, illustrating the user 202 moving onto the slackline 210.

Figure 13:
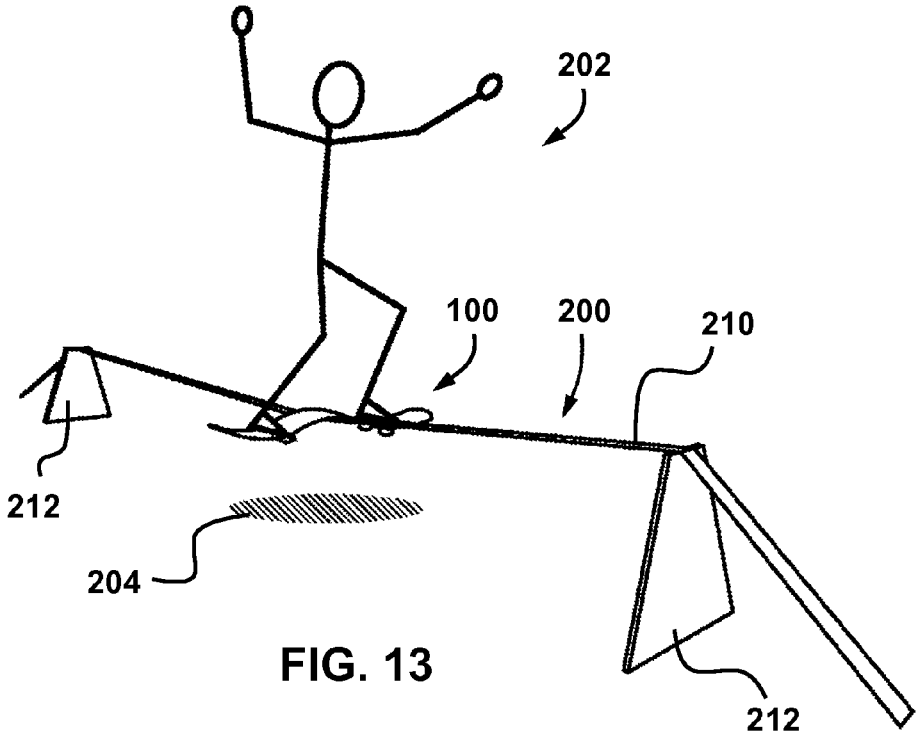
FIG. 13 is a view similar to FIG. 7, illustrating the user balancing over the slackline while the slackline engages the center of the curved arched surface underneath the slackline balance board.

FIG. 13 is a view similar to FIG. 7, illustrating the user 202 balancing over the slackline 210 while the slackline 210 engages the center of the curved arched surface underneath the slackline balance board 100.

Figure 14:
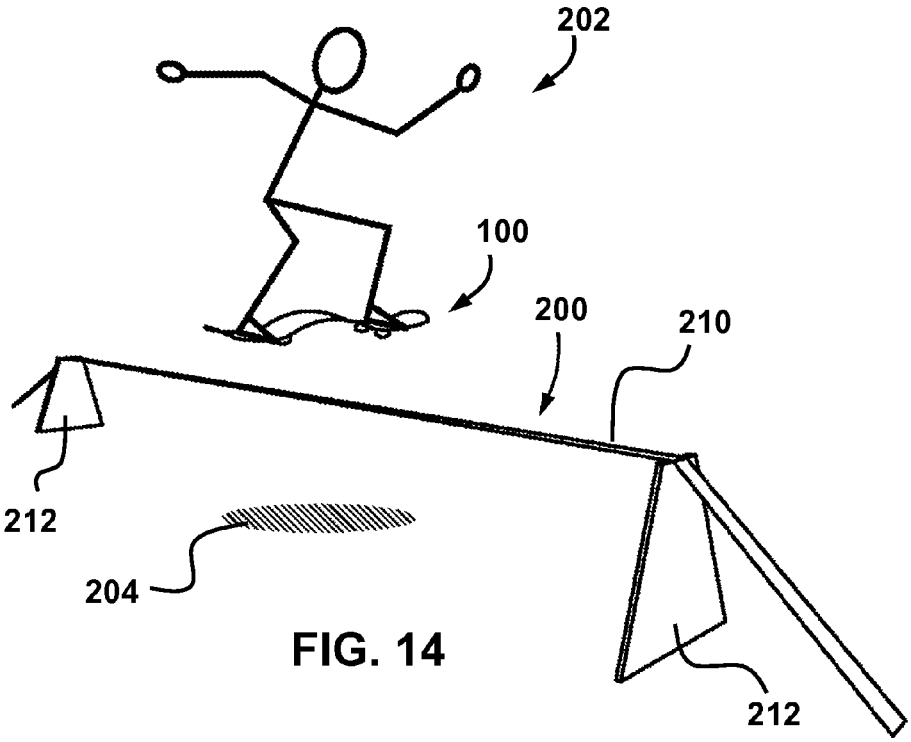
FIG. 14 is a view similar to FIG. 7, illustrating the user bouncing above the slackline.

FIG. 14 is a view similar to FIG. 7, illustrating the user 202 bouncing and propelled upwards above the slackline 210. Since the slackline 210 can act as a trampoline, this airborne maneuver can be easily achieved with the slackline balance board 100 even by novice users. Users can perform acrobatic stunts of increasing complexity as they master the skills of handling the slackline balance board 100.

Figure 15:
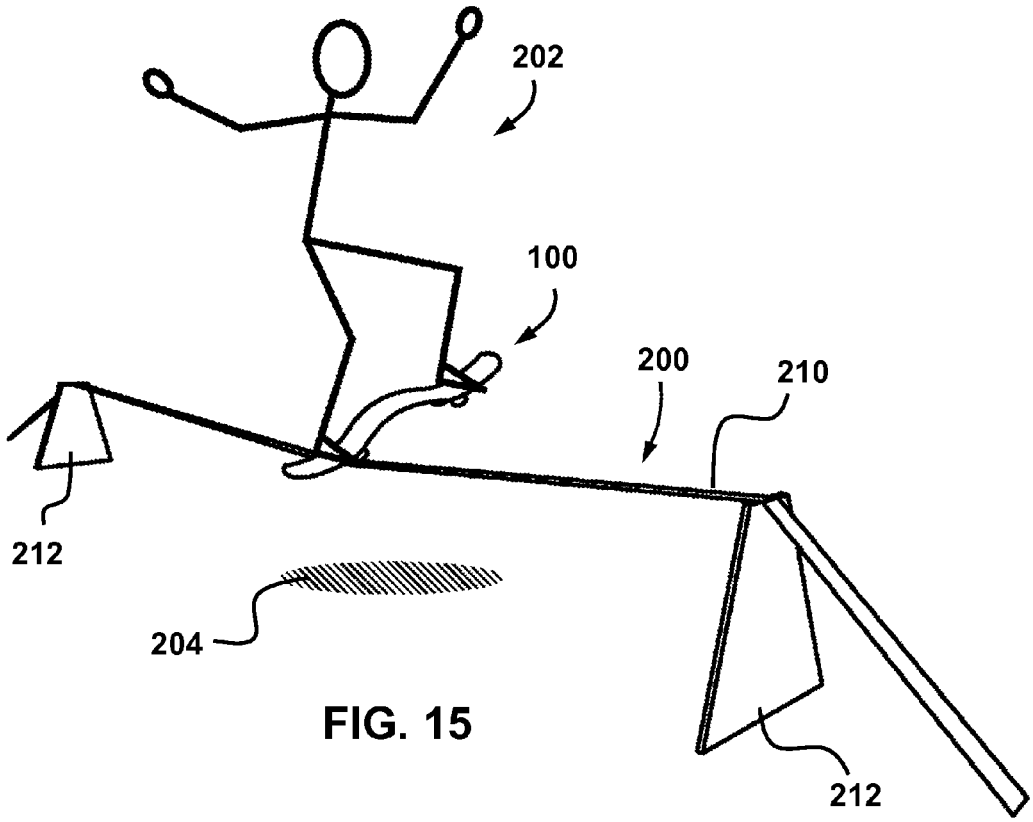
FIG. 15 is a view similar to FIG. 7, illustrating the slackline balance board engaging the slackline at only one of its end sections while the user remains in a balancing position.

FIG. 15 is a view similar to FIG. 7, illustrating the slackline balance board 100 engaging the slackline 210 only at one of its end sections 110, 112 while the user 202 remains in a balancing position. This can also represent the user 202 of FIG. 14 landing onto the slackline 210 at a different position than that of FIG. 13, for instance. The slackline 210 is then right under the user's right foot or slightly inwards. The right slackline guide 130 prevents the board 100 from slipping sideways. The user 202 must maintain the balance position or change position.

Figure 16:
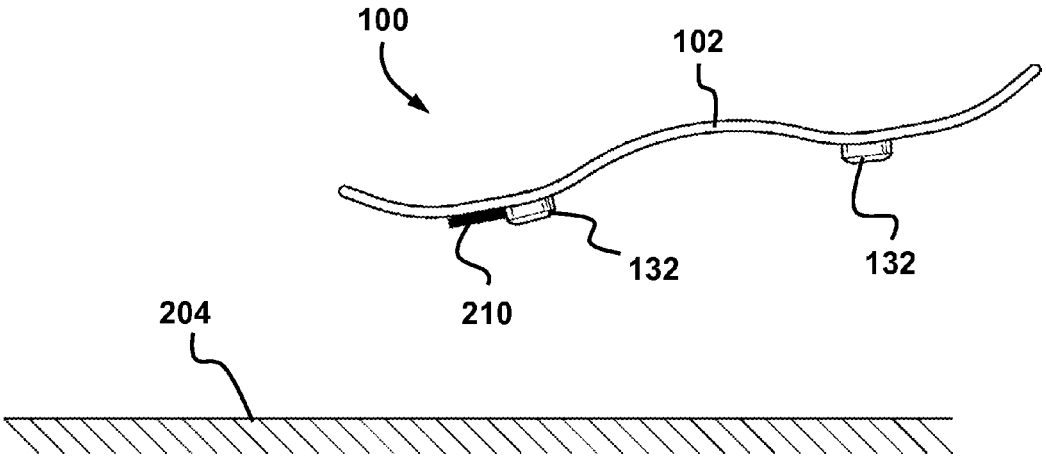
FIG. 16 is a view similar to FIG. 8, illustrating the slackline balance board and the slackline in FIG. 15 without the user.

FIG. 16 is a view similar to FIG. 8, illustrating the slackline balance board 100 and the slackline 210 in FIG. 15 without the user.

Figure 17:
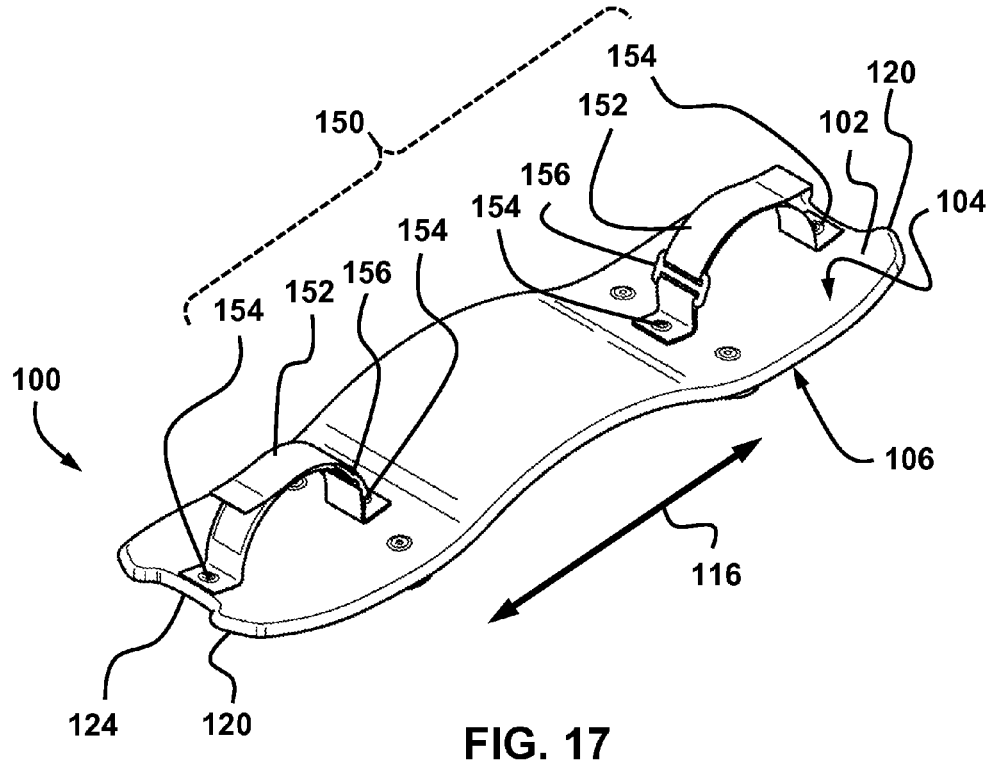
FIG. 17 is a top perspective view of another example of a slackline balance board in accordance with the proposed concept.

FIG. 17 is a top perspective view of another example of a slackline balance board 100 in accordance with the proposed concept. As can be seen, this slackline balance board 100 includes a foot retaining system 150. The deck 102 of this slackline balance board 100 is similar to that of FIG. 1, with the exception that each of the tips 120 includes a slackline guiding notch 124 and a moderate upward curve compared to that of FIG. 1. The notches 124 are designed for directly engaging the slackline 210 in some acrobatic maneuvers, for instance when the slackline balance board 100 is parallel to the slackline 210. Variants are possible.

The foot retaining system 150 allows the user's feet to remain attached to the slackline balance board 100 during the different moves (jumps, rotations, etc.). The foot retaining system 150 may be integral (much like snowboard bindings where parts must be detached or otherwise opened to release a foot) or partial (allowing the foot to be slid out more easily if desired). The illustrated foot retaining system 150 is a partial type. Variants are possible as well.

The illustrated foot retaining system 150 has two sides, namely one for the right foot and one for the left foot. Each side includes a pair of adjustable straps 152. One end of these straps 152 is secured to the upper surface 104 of the deck 102, for instance using screws 154 or similar kinds of fasteners that were attached to preinstalled inserts provided on the deck 102. Variants are possible as well. These straps 152 of each pair form a loop and the size of the loop can be adjusted, in the illustrated example, using corresponding buckles 156. Velcro bands can also be used. Other variants are possible as well. The straps 152 are generally oriented parallel to the longitudinal axis 116 in the example and the user will insert his or her feet from the side of the slackline balance board 100. The user's feet will be substantially parallel to one another (flat stance).

Even if one does not provide a complete foot retaining system on a board 100, it is possible to manufacture the deck 102 of the board 100 with preinstalled threaded inserts at various locations. These preinstalled threaded inserts are made integral with deck and are opened on the upper surface for solidity. The inserts can be made, for instance, of metal or plastics. Other materials are possible as well. They may allow a user to purchase a board 100 without a foot retaining system and to select a foot retaining system later and/or to use a foot retaining system that the user had on a previous board 100. Straps and other binding elements can be easily installed with the preinstalled threaded inserts.

Figure 18:
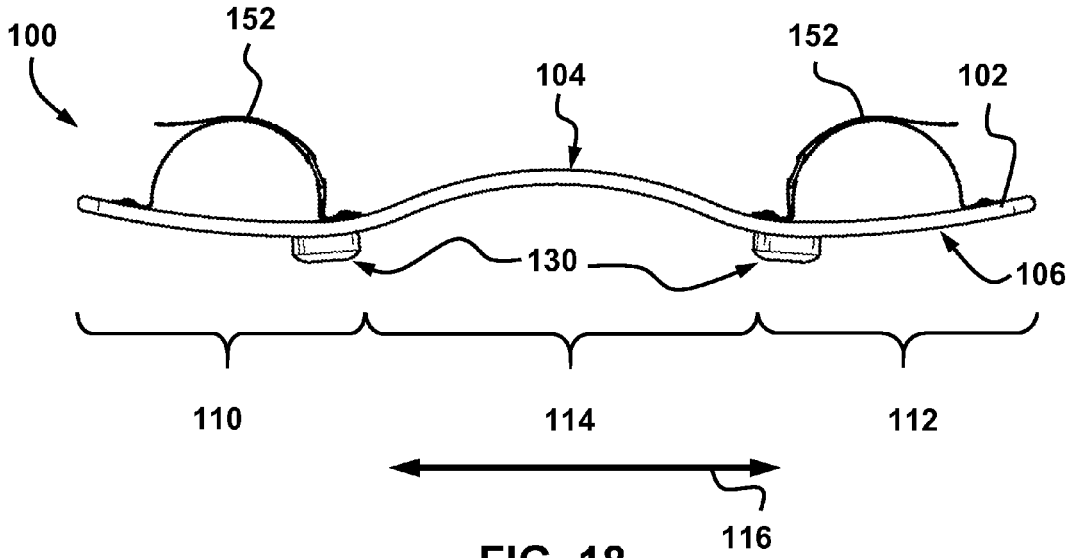
FIG. 18 is a side view of the slackline balance board shown in FIG. 17.
Figure 19:
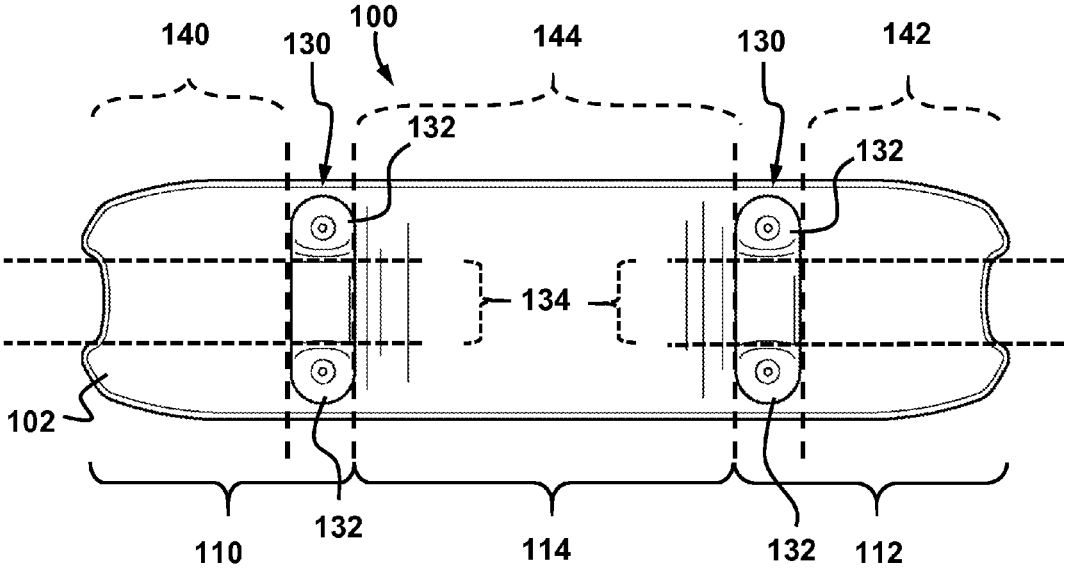
FIG. 19 is a bottom view of the slackline balance board shown in FIG. 17.
Figure 20:
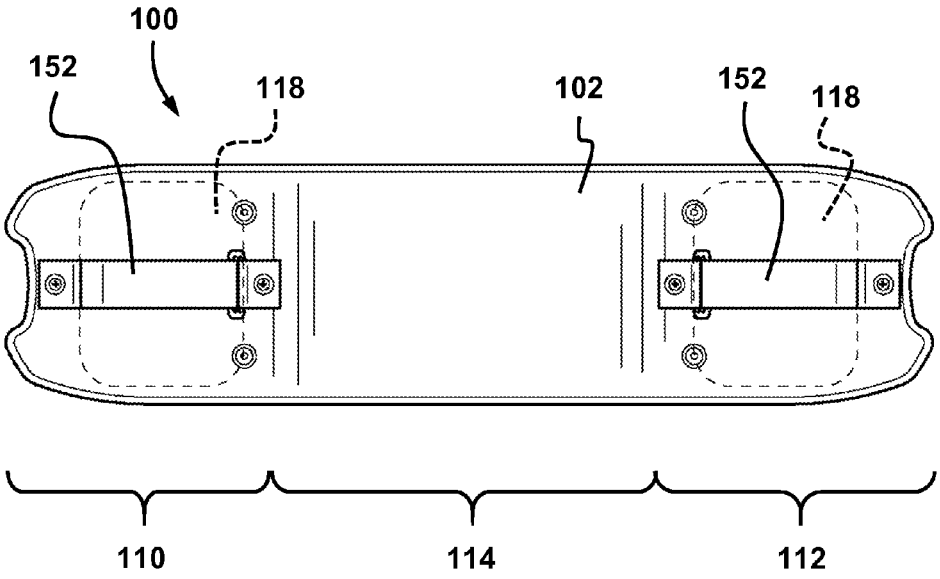
FIG. 20 is a top view of the slackline balance board shown in FIG. 17.
Figure 21:
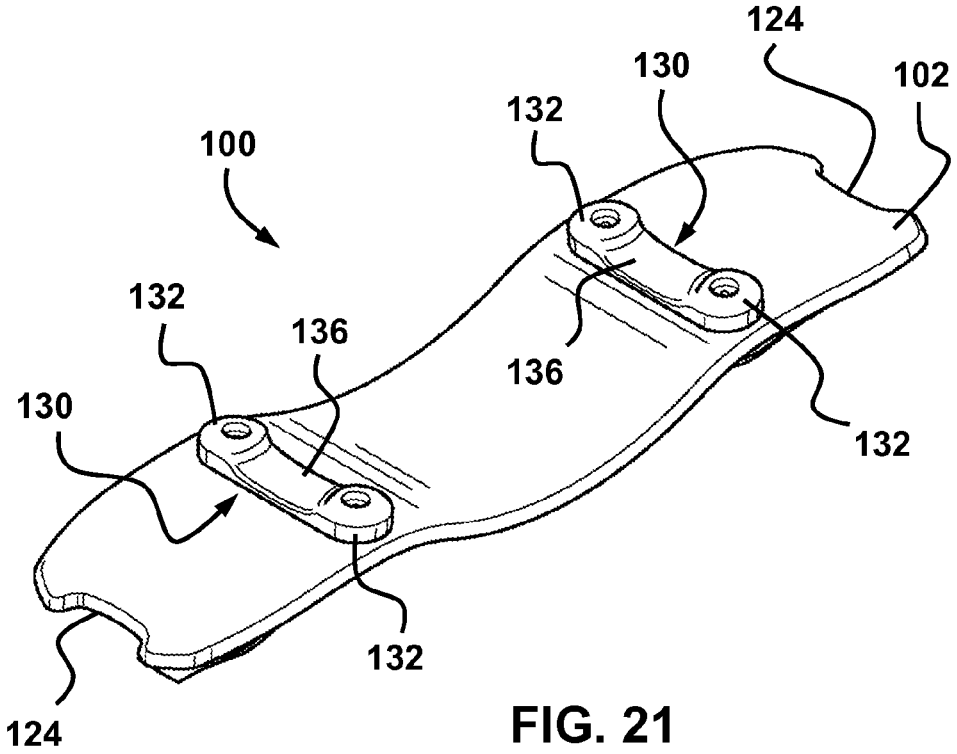
FIG. 21 is a bottom perspective view of the slackline balance board shown in FIG. 17.
Figure 22:
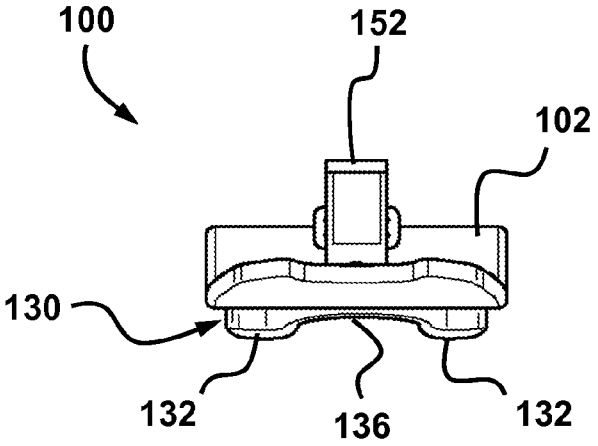
FIG. 22 is an end view of the slackline balance board shown in FIG. 17.

FIG. 18 is a side view of the slackline balance board 100 shown in FIG. 17. FIG. 19 is a bottom view of the slackline balance board 100 shown in FIG. 17. FIG. 20 is a top view of the slackline balance board 100 shown in FIG. 17. FIG. 21 is a bottom perspective view of the slackline balance board 100 shown in FIG. 17. FIG. 22 is an end view of the slackline balance board 100 shown in FIG. 17.

As can be seen in FIGS. 19, 21 and 22, the slackline guides 130 provided on the slackline balance board 100 of FIG. 17 are slightly different from the ones of the slackline balance board 100 in FIG. 1. The adjacent guide members 132 are made integral with one another since they are both part of a same one-piece slackline guide 130. The body of each slackline guide 130 has an upwardly-curved bottom surface 136 in this example. The inner sides of the guide members 132 and the upwardly-curved bottom surface 136 form the boundaries of the corresponding longitudinal slackline-receiving channels 134. When this slackline balance board 100 is horizontal and parallel to the slackline 210, the slackline 210 will be engaged by the two spaced-apart upwardly curved bottom surfaces 136. The side walls of the body of the slackline guides 130 are parallel to the transversal direction. Variants are possible as well.

Figure 23:
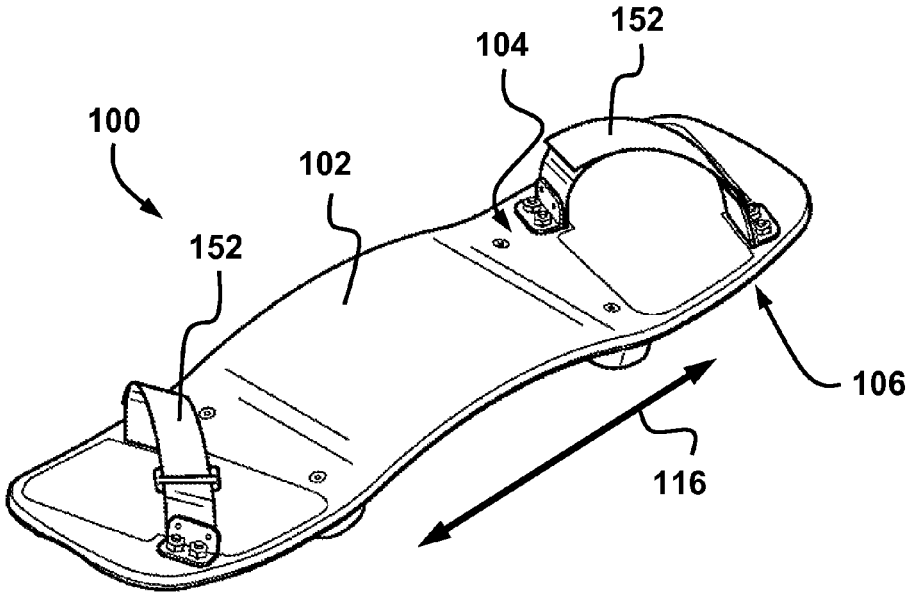
FIG. 23 is a top perspective view of another example of a slackline balance board in accordance with the proposed concept.

FIG. 23 is a top perspective view of another example of a slackline balance board 100 in accordance with the proposed concept. As can be seen, this slackline balance board 100 includes another example of a foot retaining system 150. The deck 102 of the slackline balance board 100 is similar to that of FIG. 1, with the exception that each of the tips 120 includes a concave recess 160 on the bottom surface 106 and a moderate upward curve compared to that of FIG. 1. The concave recesses 160 are designed for directly engaging the slackline 210 during some acrobatic maneuvers, when the slackline balance board 100 is disposed parallel to the slackline 210. Variants are possible as well.

In FIG. 23, the foot retaining system 150 is a partial type. The left side and the right side of the foot retaining system 150 are set obliquely on the corresponding end sections 110, 112. They are also at opposite angles from one another so that the user's feet will be angled outwards in opposite directions (duck stance). This configuration allows users to somewhat "lock" their feet by inserting each foot into the corresponding left and right sides, and then by rotating their heels outwards (eversion). The feet will stay in place even if the straps are not very tight around the user's feet. To release the feet, the user only needs to rotate his or her heels inwards (inversion) and move each foot backwards to exit the foot retaining system 150. It should be noted that the foot retaining system 150 of FIG. 23 can be implemented on the other examples. Variants are possible as well.

Figure 24:
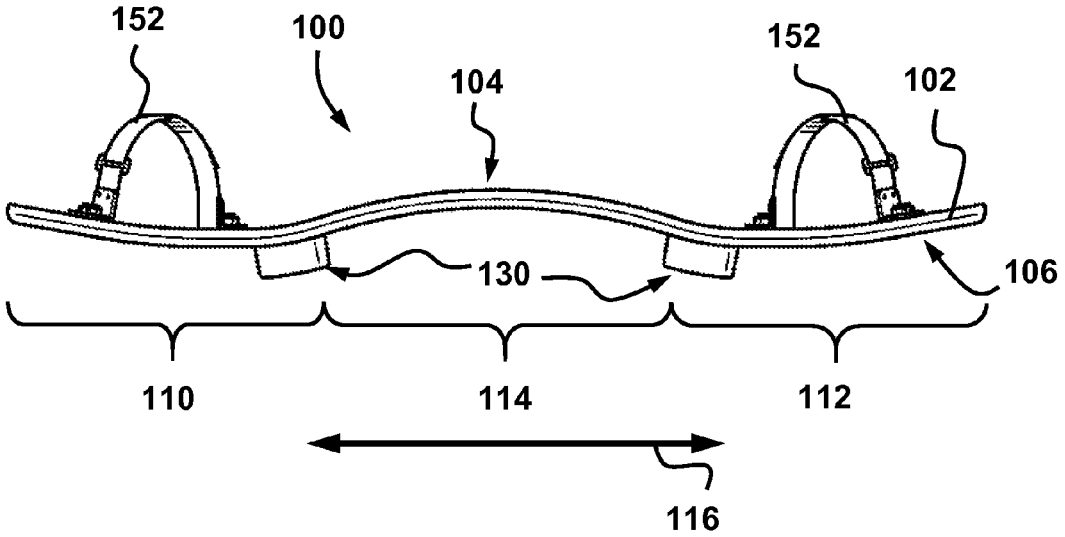
FIG. 24 is a side view of the slackline balance board shown in FIG. 23.
Figure 25:
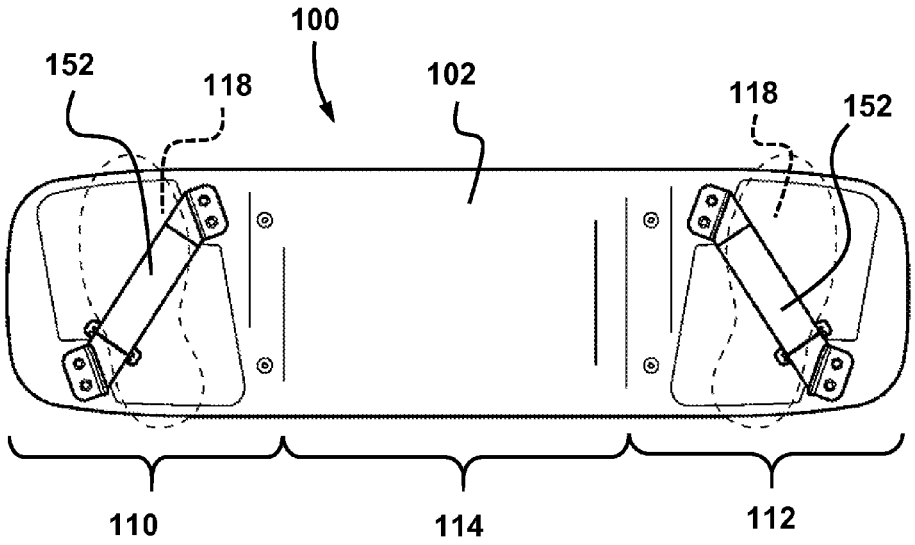
FIG. 25 is a top view of the slackline balance board shown in FIG. 23.
Figure 26:
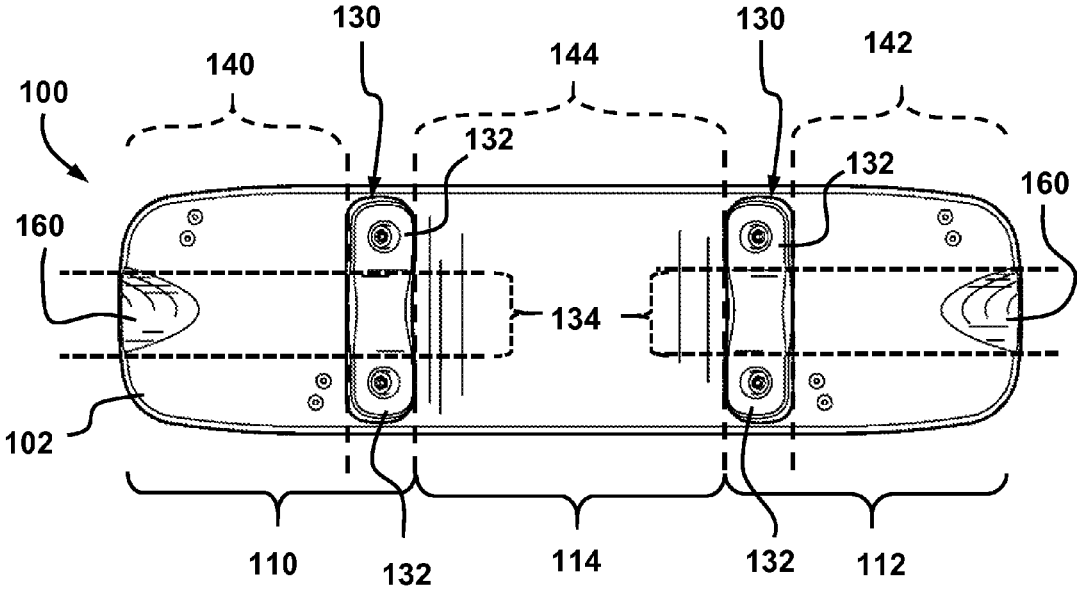
FIG. 26 is a bottom view of the slackline balance board shown in FIG. 23.
Figure 27:
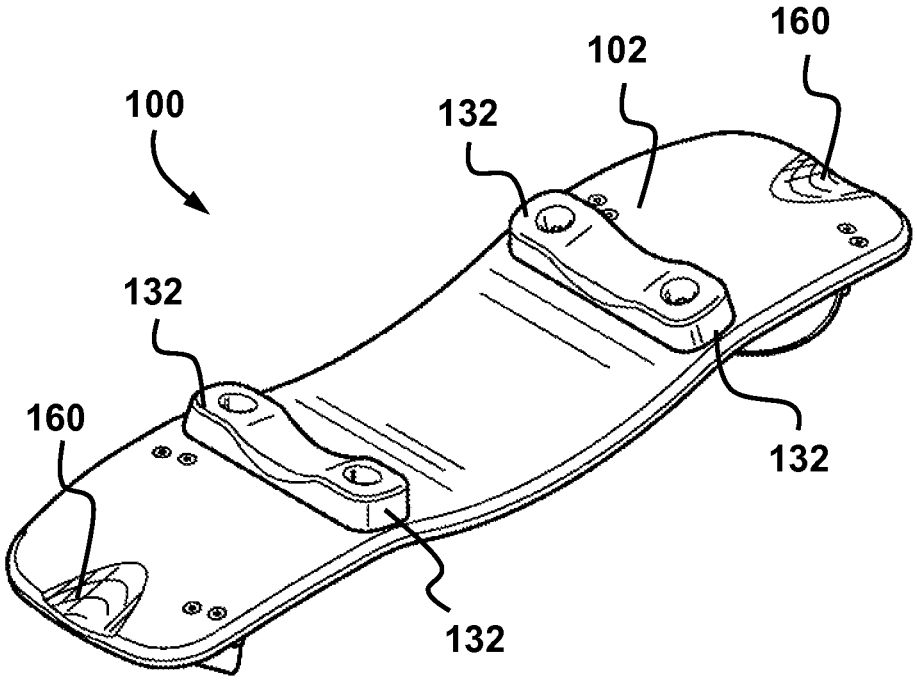
FIG. 27 is a bottom perspective view of the slackline balance board shown in FIG. 23.
Figure 28:
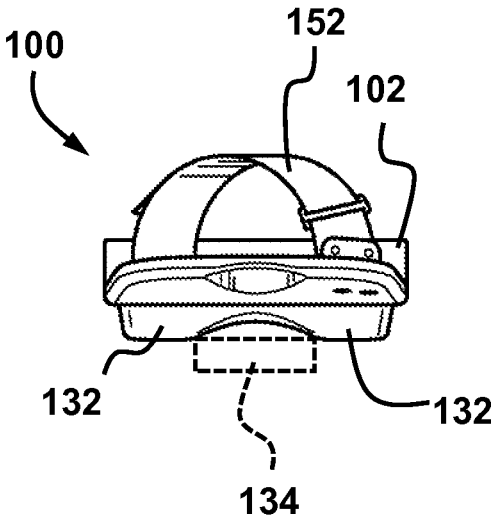
FIG. 28 is an end view of the slackline balance board shown in FIG. 23.

FIG. 24 is a side view of the slackline balance board 100 shown in FIG. 23. FIG. 25 is a top view of the slackline balance board 100 shown in FIG. 23. FIG. 26 is a bottom view of the slackline balance board 100 shown in FIG. 23. FIG. 27 is a bottom perspective view of the slackline balance board 100 shown in FIG. 23. FIG. 28 is an end view of the slackline balance board 100 shown in FIG. 23.

As can be seen, the slackline balance board 100 of FIGS. 23 to 28 include many feature of the previous example. There are also many other possible implementations that can be made based on the proposed concept.

It should be noted that preinstalled inserts for the foot retaining system 150 can be seen in FIGS. 26 and 27.

Overall, the slackline balance board 100 of the proposed concept gives users new possibilities. It is somewhat a mix between a bouncing board for use with a trampoline, and a traditional balance board. Creative boarders will soon unveil the full potential of this new sport.

The present detailed description and appended figures are only examples. A person working in this field will be able to see that variations can be made while still staying within the framework of the proposed concept. For instance, the medial cambered section 114 of the deck 102 could be partially opened instead of being an uninterrupted solid surface. The upper surface 104 and the bottom surface 106, in such medial cambered section 114, would be provided by the upper and bottom surfaces of elongated and narrow rigid members attaching the two opposite end sections 110, 112. The slackline guides 130 can also include a flanged portion projecting into the inner guiding area 144. These flanged portions could face one another and act as hooks for further holding the board 100 on the slackline 210. The exact shape of the deck 102 can be different from what is shown. The slackline guides 130 could be disposed in a non-parallel manner with reference to one another in some implementations. Different other kinds of foot retaining systems can be used. The angle of the straps or of other kinds of foot retaining devices can be different to what is shown and described. As users become more experienced, they can experiment with different stances to find what is best for them.

LIST OF REFERENCE NUMERALS

100 slackline balance board
102 deck
104 upper surface
106 bottom surface
110 first end section
112 second end section
114 medial cambered section
116 longitudinal direction
118 substantially flat footrest zone
120 tip
122 hole
124 slackline guiding notch
130 slackline guide
132 guide member
134 longitudinal slackline-receiving channel
140 first outer guiding area
142 second outer guiding area
144 inner guiding area
146 friction-enhancing strip
150 foot retaining system
152 strap
154 screw
156 buckle
160 concave recess
200 generic slackline arrangement
202 user
204 ground surface
210 slackline
212 anchor point

What is claimed is:

1. A slackline balance board for use on a slackline, the slackline balance board including:

an elongated deck having an upper surface and a bottom surface, the deck including:

opposite first and second end sections; and a medial cambered section interposed between the first and second end sections, the medial cambered section being arched upwards with reference to a longitudinal axis; and two spaced-apart slackline guides directly secured to and downwardly projecting from the bottom surface of the deck, each slackline guide having an inner transversal edge extending adjacent to a corresponding junction between the medial cambered section and a corresponding one among the first and second end sections, the two spaced-apart slackline guides separating the bottom surface underneath the board into opposite first and second outer guiding areas between which is located an inner guiding area, the inner guiding area being under the medial cambered section, each slackline guide defining a longitudinal slackline-receiving channel and the longitudinal slackline-receiving channels of the slackline guides being in registry with one another.

2. The slackline balance board as defined in claim 1, wherein each slackline guide includes two spaced-apart guide members that are each individually and independently attached underneath the deck.

3. The slackline balance board as defined in claim 2, wherein the guide members of the two slackline guides are in rectangular alignment with one another.

4. The slackline balance board as defined in claim 2, wherein each guide member has a circular cross section.

5. The slackline balance board as defined in claim 1, wherein each slackline guide includes a one-piece slacking guide body and two spaced-apart guide members that are part of the body, the body having a pair of transversally-extending side walls that are parallel to one another.

6. The slackline balance board as defined in claim 1, wherein the medial cambered section is about half an overall length of the deck.

7. The slackline balance board as defined in claim 1, wherein each of the first and second end sections includes a corresponding footrest zone on the upper surface of the deck.

8. The slackline balance board as defined in claim 1, further including a foot retaining system secured to the upper surface of the deck, the foot retaining system including a right side and a left side, each positioned above a corresponding one among the first and second end sections of the deck.

9. The slackline balance board as defined in claim 8, wherein the right side and the left side of the foot retaining system each include a corresponding set of straps attached on the deck to receive user's feet.

10. The slackline balance board as defined in claim 8, wherein the straps are oriented substantially parallel to the longitudinal axis.

11. The slackline balance board as defined in claim 9, wherein the straps are oriented obliquely and outwards with reference to the longitudinal axis to create a duck stance.

12. The slackline balance board as defined in claim 1, further including preinstalled threaded inserts that are made integral with the deck and opened at least on the upper surface of the deck, whereby the preinstalled threaded inserts are configured and disposed to receive fasteners of a foot retaining system.

13. The slackline balance board as defined in claim 1, further including two spaced-apart and parallel friction-enhancing strips affixed to the bottom surface of the board.

14. The slackline balance board as defined in claim 1, further including a pair of opposite slackline guiding notches, each notch being provided at a corresponding tip of the deck.

15. The slackline balance board as defined in claim 1, further including a pair of opposite concave recesses, each recess being located on the bottom surface at a corresponding tip of the deck.

16. The slackline balance board as defined in claim 1, wherein each slackline guide has opposite lateral ends that are surrounded by a portion of the bottom surface.

17. A slackline balance board for use on a slackline, the slackline balance board including:

an elongated deck having an upper surface and a bottom surface, the deck including:

opposite first and second end sections; and a medial cambered section interposed between the first and second end sections, the medial cambered section being arched upwards with reference to a longitudinal axis;

two spaced-apart slackline guides secured to the bottom surface of the deck; and two spaced-apart and parallel friction-enhancing strips affixed to the bottom surface of the board.

18. A slackline balance board for use on a slackline, the slackline balance board including:

an elongated deck having an upper surface and a bottom surface, the deck including:

opposite first and second end sections; and a medial cambered section interposed between the first and second end sections, the medial cambered section being arched upwards with reference to a longitudinal axis;

two spaced-apart slackline guides secured to the bottom surface of the deck; and a foot retaining system secured to the upper surface of the deck, the foot retaining system including a right side and a left side, each secured atop a corresponding one among the first and second end sections of the deck.

19. The slackline balance board as defined in claim 18, wherein the right side and the left side of the foot retaining system each include a corresponding set of straps attached on the deck to receive user's feet.

20. The slackline balance board as defined in claim 5, wherein on each slackline guide, the body includes an upwardly-curved bottom surface extending between the two guide members and forming the corresponding longitudinal slackline-receiving channel.

* * * * *